United States Patent [19]

Grilliot et al.

[11] Patent Number: 5,001,781

[45] Date of Patent: Mar. 26, 1991

[54] FIREFIGHTER'S GARMENTS HAVING ENHANCED THERMAL INSULATION WHILE HAVING MINIMUM WEIGHT

[76] Inventors: William L. Grilliot; Mary I. Grilliot, both of 1986 Home Ave., Dayton, Ohio 45417

[21] Appl. No.: 422,072

[22] Filed: Oct. 16, 1989

[51] Int. Cl.[5] ..... A41D 13/00

[52] U.S. Cl. ..... 2/69; 2/81; 2/97

[58] Field of Search ..... 2/7, 8, 70, 79, 81, 2/92, 93, 243 A, 243 R, DIG. 4, 69, 81, 97; 428/166, 201, 920, 921

[56] References Cited

U.S. PATENT DOCUMENTS

| | | | |
|---|---|---|---|
| 440,998 | 11/1890 | Appel . | |
| 1,082,214 | 12/1913 | Robinson . | |
| 2,483,015 | 9/1949 | Levy . | |
| 2,627,072 | 2/1953 | Frommelt et al. | 2/97 X |
| 2,709,667 | 5/1955 | Grubb . | |
| 3,231,899 | 2/1966 | Seidel . | |
| 3,292,179 | 12/1965 | Iacono . | |
| 3,563,198 | 2/1971 | Johnston | 2/81 X |
| 3,925,823 | 12/1975 | Kupferman | 2/81 |
| 4,223,064 | 9/1980 | Ballif, III et al. | 2/81 X |
| 4,401,707 | 8/1983 | Bailey et al. | 2/243 A X |
| 4,502,153 | 3/1985 | Lapedes et al. | 2/81 |
| 4,509,213 | 4/1985 | Harvey . | |
| 4,549,315 | 10/1985 | English et al. | 2/79 X |
| 4,569,088 | 2/1986 | Frankenburg et al. | 2/81 |
| 4,583,247 | 4/1986 | Fingerhut et al. | 2/81 X |
| 4,604,759 | 8/1986 | Bowman et al. | 2/97 X |
| 4,805,244 | 2/1989 | Scott | 2/69 X |
| 4,849,280 | 7/1989 | Coombs | 428/920 X |
| 4,860,382 | 8/1989 | Markwell | 2/69 X |
| 4,890,336 | 1/1990 | Worton | 2/79 |

FOREIGN PATENT DOCUMENTS

| | | | |
|---|---|---|---|
| 460669 | 11/1949 | Canada . | |
| 1056553 | 6/1979 | Canada | 2/81 |
| 366919 | 1/1939 | Italy . | |
| 638665 | 10/1983 | Switzerland | 2/69 |

OTHER PUBLICATIONS

Custom-Deluxe Turnouts, Janesville Apparel, 1986.
Express-Guard TM Turnouts of Nomex III Aramid, Body-Guard, Division of Lion Apparel.
We've been building up to this Project Fires suit for one hundred years, Globe Firefighters Suits.

*Primary Examiner*—Allan N. Shoap
*Assistant Examiner*—Scott Cummings
*Attorney, Agent, or Firm*—Jacox & Meckstroth

[57] ABSTRACT

A firefighter's garment having enhanced thermal insulation qualities while also having minimum weight and maximum flexibility. The firefighter's garment has an outer shell of abrasion resistant and flame resistant material, within the outer shell is a layer of moisture resistant material, the layer of moisture resistant material covers a layer of thermal insulation which has given thermal insulation qualities. Attached to the layer of thermal insulation material which has given thermal insulation qualities is a layer of thermal insulation material which has greater thermal insulation qualities. The layer of thermal insulation material which has greater thermal insulation qualities is positioned within the firefighter's garment in the regions of the firefighter's garment which are subjected to the highest heat loads.

17 Claims, 2 Drawing Sheets

FIREFIGHTER'S GARMENTS HAVING ENHANCED THERMAL INSULATION WHILE HAVING MINIMUM WEIGHT

BACKGROUND OF THE INVENTION

During the fighting of a fire, a firefighter works in a very hostile environment. Many firefighter's lose their lives while fighting fires. Most of the deaths of firefighters while fighting fires result from stress, heart attacks, strokes, and the like. Of course, a firefighter must be protected from the environment within which the firefighter works. However, in an attempt to provide adequate protection, the garments of firefighters have been too heavy, too bulky, while also lacking flexibility. Such heavy, bulky, low flexibility garments cause excessive stress within a firefighter who wears the garment.

A firefighter's garment customarily has a plurality of layers of material, including: an outer shell, which is flame resistant and which resists punctures and abrasions, an intermediate layer, which is a moisture barrier, and an inner layer which is a thermal barrier. These layers my be three distinct layers or one or two members. Furthermore any one of the layers may comprise a plurality of layers or sections.

In the past, the inner liner or thermal barrier in a firefighter's garment has been completely one material and the same composition throughout. The materials available for an inner liner of a firefighter's garment vary considerably. As a rule, the more insulative an inner liner is, the more bulky and less flexible is the liner. Therefore, the more bulky a liner is, the more stress is placed upon the firefighter who wears the garment. Conversely, the less insulative material in the inner liner, the less bulky the inner liner is. However, less bulk ordinarily provides less protection. In the past, fire departments have made a choice of liner materials. This choice of a liner material constituted a choice of a liner material for the entire garment. The liner material chosen has been a compromise between the most insulative (the most bulky) material and the least acceptable insulative (the least bulky) material. Thus, a fire department has desired to ensure that the firefighter be provided with good insulation. However, the insulation chosen was often not the best insulation available, since a significant degree of flexibility in the garments was also desired.

In U.S. Pat. No. 4,843,646 the Applicants herein addressed the desirability of mixing liner materials in body parts of firefighter's garments. The invention herein recognizes that portions of a firefighter's garments interface with body parts in which flexibility in movement is a particularly critical need, for example back of knees, front of elbows, etc. These "flexing" areas or portions are flexed during firefighting, since firefighters crouch &o the floor where the temperature is coolest. The liner portions which are flexed bunch during flexing, and the insulative performance is increased in these areas, as compared to the same material in a single unbunched layer. However, increased insulative performance is not required in these areas or portions, and the bunching of heavy material reduces flexibility. Therefore, such flexing portions or interfaced portions of the garments should properly feature insulation material of the least acceptable weight and least bulkiness. Thus, these areas should have the least acceptable insulation. In the past, if the least bulky (least insulative) material should be employed in these body areas, the entire garment would contain the least insulative material, since conventional liners have been entirely of one material.

The invention herein recognizes that many of the portions of a firefighter's garment should have the most insulative (also heaviest, most bulky) material possible. For instance, since a firefighter always frontally approaches the fire in a crouched position, his shoulders, thighs, and back receive a maximum heat load. Those body areas also are not flex areas and do not receive back up protection from another part of the protective envelope. That is, these body areas do not receive back up protection from boots, gloves, etc. In the past, if the most insulative (most bulky) material were used in these maximum heat load body areas, the same heavy bulky insulative material would also be used in body areas in which less bulky material was more optimal.

Therefore, the problem solved in this invention is the creation of a firefighter's protective clothing system which addresses the fact that certain body parts require a high degree of heat insulation, without detriment to the needs of other body parts for maximum flexibility.

It is an object of this invention to provide firefighters' garments which include maximally insulative, heavier liner materials in areas in which maximum insulative protection is required, such as shoulders, back, thighs, etc. Also, an object of this invention is to provide in the same garments, by contrast, lighter, more flexible (hence comparatively less insulative) liner materials in areas in which greater insulation is not required and in areas which are flexed and/or which interface with other protective garments.

It is another object of this invention to provide a firefighter's protective clothing system which is minimally stressful, that is lighter in weight and permitting ease of movement, while being adequately protective.

It is another object of this invention to provide a firefighter's protective clothing system in which the non-varying influence of a firefighter's posture during firefighting is recognized. That recognition relates to the fact that certain body parts face the highest heat loads, and these body parts require greater thermal insulation protection.

Other objects and advantages of this invention reside in the construction of parts, the combination thereof, the method of construction and the method of use, as will become more apparent from the following description.

SUMMARY OF THE INVENTION

This invention pertains to a firefighter's coat and trousers. Many portions of a firefighter's coat are subjected to high heat loads. Such portions are, for example the shoulder and chest areas and portions of the sleeves. Also, several portions of the trousers are subjected to high heat loads. These portions are, for example: parts of the leg and thigh regions and parts of the torso regions.

In this invention an adequate level of thermal insulation is provided in all regions of the firefighter's garments. Also, greater thermal insulation is provided in regions of the firefighter's garments in which high heat loads are experienced. Furthermore, in this invention the thickness and bulkiness of the thermal liner are less in the portions of the garments in which high heat loads are not experienced. Thus, the garment has greater flexibility and less weight in these areas. However, the necessary degree of thermal protection in these areas is also provided. Thus, even though flexibility is enhanced, and the weight of the garments is reduced; the degree of protection of the firefighter against the hostile environment is not effectively decreased. Reduced weight and greater flexibility in regions of the garments which are not subjected to high heat loads reduces stress upon the firefighter. Therefore, stress resulting from the weight and use of the firefighter's garments is reduced.

In this invention, the fact is recognized that many of the areas of a firefighter's garments require a high degree of thermal insulation, while many areas of the firefighter's garments do not require a high degree of thermal insulation.

In this invention a firefighter's garment includes a layer of relatively flexible thermal protective material throughout the garment. The garment includes additional thermal protective material in regions in which high heat loads are experienced and in which greater thermal protection is required. Thus, the firefighter who wears a garment of this invention is adequately protected while the firefighter wears a garment in which stress upon the firefighter as a result of the composition and structure of the garment is a minimum.

DETAILED DESCRIPTION OF THE INVENTION

Figure 1:
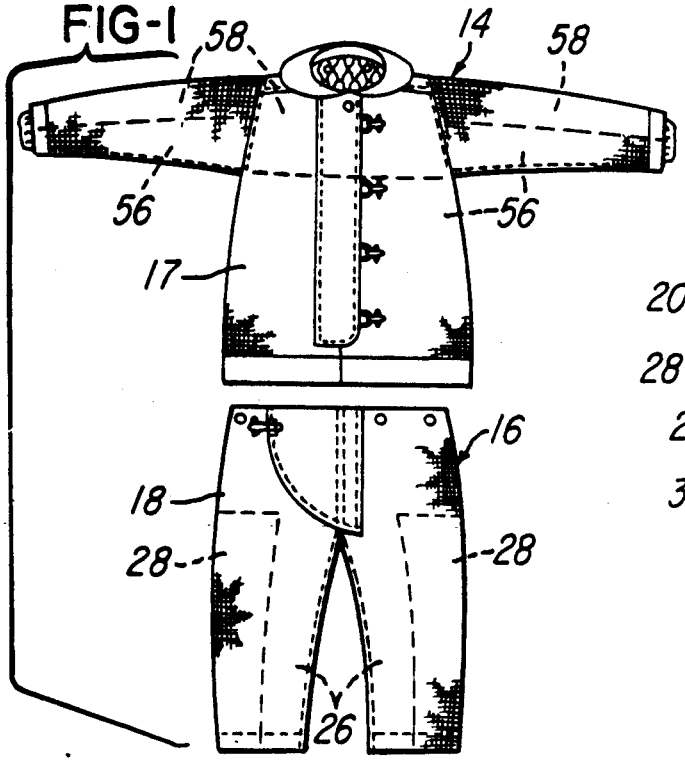
FIG. 1 is a front elevational view showing a firefighter's coat and trousers constructed in accordance with this invention.

FIG. 1 shows a firefighter's coat 14 and a firefighter's trousers 16. The firefighter's coat 14 has an outer shell 17, and the firefighter's trousers 16 has an outer shell 18.

The outer shell 18 of the trousers 16 is of flame resistant and abrasion resistant material, which, for example, may be any suitable high temperature nylon material or the like. The outer shell 18 of the trousers 16 encloses a moisture barrier layer 20, which may be for example, neoprene material, or a polytetrafluoroethylene material, or any other suitable moisture barrier material. The moisture barrier layer 20 extends through substantially the entire trousers 16.

The moisture barrier layer 20 encloses a thermal barrier layer 24 which extends through substantially the entire trousers 16 and, preferably, has substantially the same thermal insulation and flexibility characteristics throughout the entire trousers 16.

Figure 4:
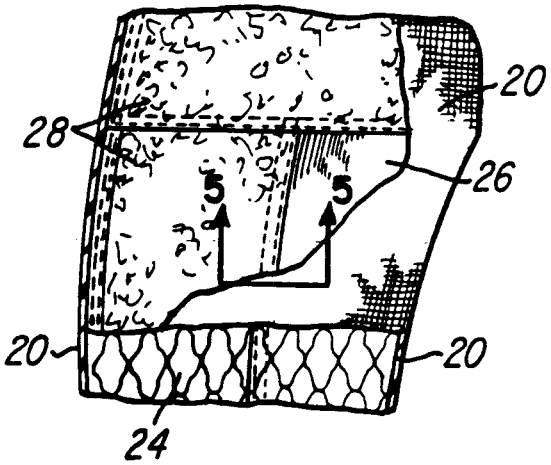
FIG. 4 is an enlarged fragmentary view, with parts broken away and shown in section, showing a portion of the protective layers which appear in FIG. 3.
Figure 5:
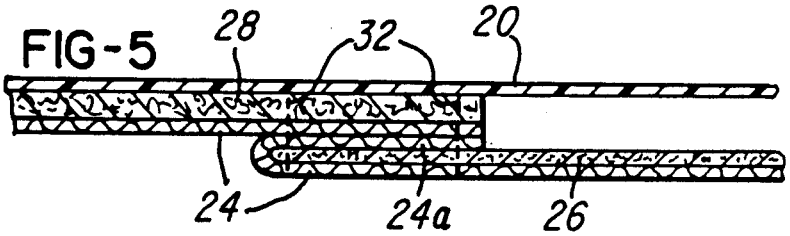
FIG. 5 is an enlarged sectional view taken substantially on line 5—5 of FIG. 4.

As best illustrated in FIGS. 4 and 5, attached to and/or carried by the thermal barrier layer 24 is a thermal barrier layer 26 which extends through a major portion of the trousers 16. The thermal barrier layer 26, has given thermal insulation qualities which are different from the thermal insulation qualities of the thermal barrier layer 24. The thermal barrier layer 26 is shown positioned between the thermal barrier layer 24 and the moisture barrier layer 20.

Also attached to the thermal barrier layer 24 is a thermal barrier layer 28. The thermal barrier layer 28 has greater thermal insulation qualities than the thermal barrier layer 26.

The portion of thermal barrier layer 24 which carries the thermal barrier layer 26 is connected to the portion of the thermal barrier layer 24 which carries the thermal barrier layer 28 in any suitable manner. As illustrated in FIG. 5, the thermal barrier layer 24 has a bent-around part 24*a* which partially encompasses a small part of the thermal barrier layer 26. The bentaround part 24*a* is attached to another part of the thermal barrier layer 24 and to the thermal barrier layer 28 by means of stitching elements 32.

FIGS. 4 and 5 show the details of the preferred form of attachment of the thermal barrier layer 26 and the thermal barrier layer 28 and to the thermal barrier layer 24. However, other means and methods of attachment of the thermal barrier layers 26 and 28 to the thermal barrier layer 24 may also be employed.

Preferably, but not necessarily, the moisture barrier layer 20 is positioned within the trousers 16 in engagement with the outer shell 18. Also, preferably, but not necessarily, the thermal barrier layers 26 and 28 are positioned in engagement with the moisture barrier layer 20, and the thermal barrier layer 24 is positioned farthest from the outer shell 18.

The thermal barrier layer 28 which has greater thermal insulation qualities than the thermal barrier layer 26 is located in the trousers 16 in regions in which the trousers 16 are subjected to the greatest heat loads as the firefighter who wears the trousers 16 works in a fire environment. Each of the thermal barrier layers 24, 26, and 28 comprises a high temperature material, which for example may be high temperature nylon material or any other suitable flame resistant and/or heat resistant material.

Figure 2:
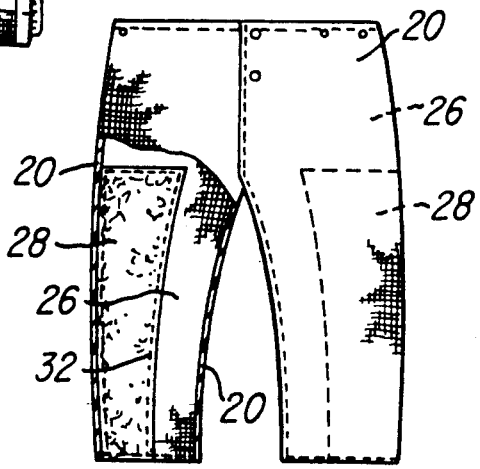
FIG. 2 is a front elevational view, drawn on a slightly larger scale than FIG. 2, with parts broken away and shown in section, showing layers of protective materials which are within the firefighter's trousers of FIG. 1.

FIGS. 2, 3, 4, and 5 show the moisture barrier layer 20 which is adapted to be positioned within the outer shell 18 and which encloses the thermal barrier layers 24, 26, and 28. The thermal barrier layer 28 has portions which are shown in FIG. 2 located at the front section of the leg parts of the trousers 16. FIG. 2 also shows that the thermal barrier layer 26 extends through the other portions of the trousers 16. Due to the fact that the moisture barrier layer extends through substantially the entire trousers 16, the moisture barrier layer 20 also encloses the thermal barrier layer 26, as shown in FIG. 2.

Figure 3:
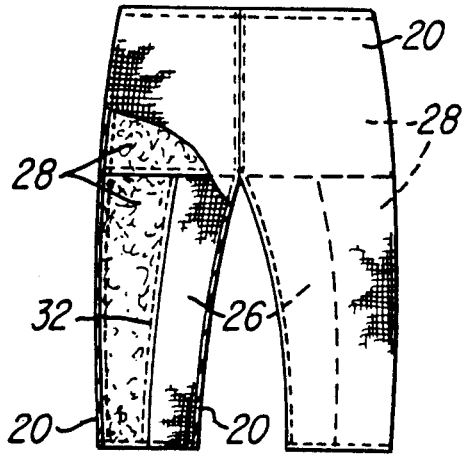
FIG. 3 is a rear elevational view, drawn on substantially the same scale as FIG. 2, with parts broken away and shown in section, showing layers of protective materials which are within the firefighter's trousers of FIG. 1.

FIG. 3 shows the rear portion of the moisture barrier layer 20 as the moisture barrier layer 20 encloses the thermal barrier layers 26 and 28 FIG. 3 shows that the thermal barrier layer 28 is located at the rear of the leg sections of the trousers 26. FIG. 3 also shows that the thermal barrier layer 28 is also located in the rear part of the trousers 16 in the torso region of the trousers 16. FIG. 3 also shows that the thermal barrier layer 26 extends through the other portions of the trousers 16.

The outer shell 17 of the firefighter's coat 14 is of flame resistant and abrasion resistant material, which may be, for example, any suitable high temperature nylon material, or the like. The outer shell 17 encloses a moisture barrier layer 50, shown in FIGS. 6 and 7, which may be, for example, neoprene material, or a poly teflon fluro ethylene material, or any other suitable moisture barrier material. The moisture barrier layer 50 encloses a thermal barrier layer 54. The thermal barrier layer 54 extends through substantially the entire coat 14 and has substantially the same thermal insulation qualities throughout the entire coat 14.

The thermal barrier layer 54 has a portion thereof which supports a thermal barrier layer 56 which has thermal insulation qualities different from the thermal insulation qualities of the thermal barrier layer 54. The thermal barrier layer 54 has a portion thereof which supports a thermal barrier layer 58. The thermal barrier layer 56 has given thermal insulation qualities. The thermal barrier 58 has greater thermal insulation qualities than the thermal barrier layer 56.

Figure 9:
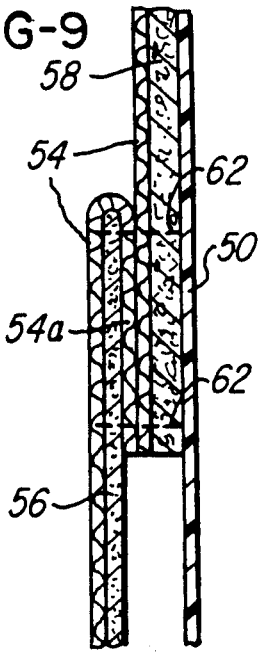
FIG. 9 is an enlarged sectional view taken substantially on line 9—9 of FIG. 8.

The thermal barrier layers 56 and 58 are connected to or carried by the thermal barrier layer 54 in any suitable manner. FIG. 9 illustrates a method by which the thermal barrier layer 56 and the thermal barrier layer 58 are carried by the thermal barrier layer 54. The thermal barrier layer 54 has a bent-around part **54*a*. The bent-around part 54*a* is attached to another part of the thermal barrier layer 54 by means of stitching elements 62 which extend through the thermal barrier layers 54, 56, and 58. The thermal barrier layer 58 which is attached to the thermal barrier layer 54 and which has greater thermal insulation qualities than the thermal barrier layer 56 is located in the regions of the coat 14 which are subjected to the greatest heat loads as the firefighter who wears the coat 14 works in a fire environment. The thermal barrier layer 56, which is also carried by the thermal barrier layer 54, is located within other portions of the coat 14**.

Figure 6:
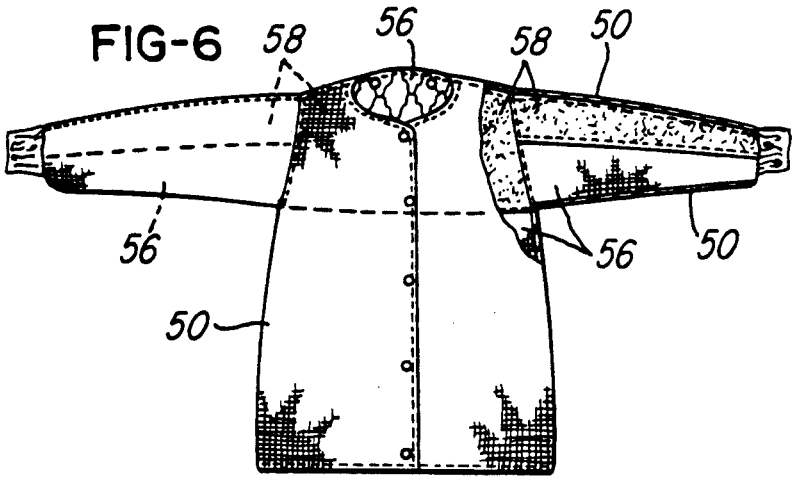
FIG. 6 is a front elevational view, drawn on a slightly larger scale than FIG. 1, with parts broken away and shown in section, showing layers of protective material within the firefighter's coat of FIG. 1.

FIG. 6 shows the moisture barrier layer 50 which encloses the thermal barrier layers 54, 56 and 58. The thermal barrier layer 58 is shown located at the upper arm and shoulder regions of the coat 14. The thermal barrier layers 56 and 58 are preferably attached to the thermal barrier layer 54 in the manner illustrated in FIG. 9. However, other means and methods of attachment of the thermal barrier layers 56 and 58 to the thermal barrier layer 54 may also be employed.

Figure 7:
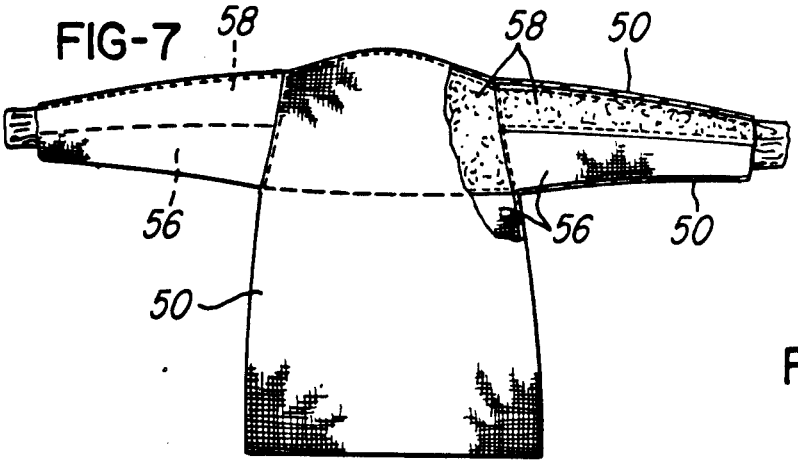
FIG. 7 is a rear elevational view, drawn on substantially the same scale as FIG. 6, with parts broken away and shown in section, showing layers of protective material within the firefighter's coat of FIG. 1.
Figure 8:
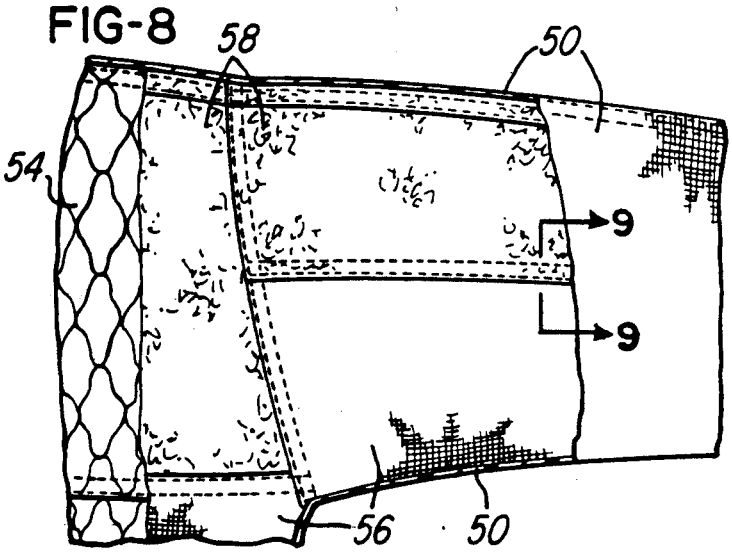
FIG. 8 is an enlarged fragmentary view, with parts broken away and shown in section, showing a portion of the layers of protective material which appear in FIG. 7.

FIG. 7 shows that the thermal barrier layer 58 is located in the upper arm parts of the sleeves of the coat 14 and at the upper back part of the coat 14.

The moisture barrier layer 50 is positioned within the coat 14 in engagement with the outer shell 17. The thermal barrier layers 56 and 58 are shown positioned in engagement with the moisture barrier layer 50 and the thermal barrier layer 54 is farthest from the outer shell 17. However, other relative positions of these layers 50, 54, 56, and 58 may also be acceptable.

SUMMARY OF THE DISCLOSURE

Thus, it is understood that this invention provides a firefighter's garments with greatest thermal insulation in the portions of the garments which are subjected to the highest heat loads. Other portions of the firefighter's garments are provided with lesser thermal insulation in portions of the garments which are not subjected to the highest heat loads. Therefore, the weight of the garments is minimum and the flexibility of the garments is maximum, while the garments completely and adequately protect a firefighter who wears the garments.

Although the preferred embodiment of the firefighter's garments of this invention has been described, it will be understood that within the purview of this invention various changes may be made in the form, details, proportion and arrangement of parts, the combination thereof, and the manner of use, which generally stated consist in a firefighter's garments within the scope of the appended claims.

The invention having thus been described, the following is claimed:

1. A firefighter's garment for complete thermal protection of the firefighter while maintaining minimum weight and maximum flexibility and for maintaining minimum stress in the firefighter during firefighting activity, the firefighter's garment being of the type having an outer shell which is of flame resistant and abrasion resistant material, a moisture barrier layer within the outer shell and extending substantially throughout the entire outer shell, and a first thermal barrier layer within the outer shell and extending substantially throughout the entire outer shell, the first thermal barrier layer having given thermal insulation qualities, the improvement comprising a second thermal barrier layer within the outer shell and carried by the first thermal barrier layer and extending throughout a major portion of said garment the second thermal barrier layer having thermal insulation qualities which are different from the thermal insulation qualities of the first thermal barrier layer, a third thermal barrier layer, the third thermal barrier layer being carried by the first thermal barrier layer and extending throughout a minor portion of said garment, the third thermal barrier layer having thermal insulation qualities different from the thermal insulation qualities of the first thermal barrier layer and different from the thermal insulation qualities of the second thermal barrier layer, whereby the firefighter's garment provides complete thermal insulation protection and complete moisture insulation protection in all areas and regions thereof while having minimum weight and maximum flexibility, the garment thus creating minimum stress in the firefighter.

2. The firefighter's garment according to claim 1 in which the second thermal barrier layer is attached to predetermined portions of the first thermal barrier layer and the third thermal barrier layer are attached to other predetermined portions of the first thermal barrier layer.

3. The firefighter's garment of claim 1 in which the third thermal barrier layer has greater thermal insulation qualities than the first thermal barrier layer and in which the third thermal barrier layer has greater thermal insulation qualities than the second thermal barrier layer.

4. The firefighter's garment of claim 1 in which the garment comprises a firefighter's coat.

5. The firefighter's garment of claim 1 in which the garment comprises a firefighter's trousers.

6. The firefighter's garment of claim 1 in which the garment comprises a coat provided with sleeve portions and chest portions, and in which the third thermal barrier layer has greater thermal insulation qualities than the first thermal barrier layer and in which the third thermal barrier layer has greater thermal insulation qualities than the second thermal barrier layer and in which the third thermal barrier layer is positioned in the sleeve portions and in the chest portions of the coat.

7. The firefighter's garment of claim 1 in which the garment compromises a coat provided with an upper part, and in which the third thermal barrier layer has greater thermal insulation qualities than the first thermal barrier layer and in which the third thermal barrier layer has greater thermal insulation qualities than the second thermal barrier layer and in which the third thermal barrier layer is positioned in the upper part of the coat.

8. The firefighter's garment of claim 1 in which the garment comprises a firefighter's trousers having leg parts and a torso part, and in which the third thermal barrier layer has greater thermal insulation qualities than the first thermal barrier layer and in which the third thermal barrier layer has greater thermal insulation qualities than the second thermal barrier layer, and in which the third thermal barrier layer is positioned in a portion of the leg parts and in a portion of the torso part of the trousers.

9. The firefighter's garment of claim 1 in which the first thermal barrier layer has a folded part and a second part, and in which the folded part of the first thermal barrier layer encompasses a portion of the second thermal barrier layer and in which the folded part and the second part of the first thermal barrier layer are attached to the second thermal barrier layer and in which the third thermal barrier layer is attached to the second part of the first thermal barrier layer.

10. The firefighter's garment of claim 1 in which the second thermal barrier layer is positioned between the moisture barrier layer and the first thermal barrier layer.

11. The firefighter's garment of claim 1 in which the third thermal barrier layer is positioned between the first thermal barrier layer and the moisture barrier layer.

12. A firefighter's coat for complete thermal protection while maintaining minimum weight and maximum flexibility and for maintaining minimum stress in the firefighter during firefighting activities, the firefighter's coat having sleeve portions and shoulder portions, the firefighter's coat being of the type having an outer shell of flame resistant and abrasion resistant material, a moisture barrier layer covered by the outer shell and extending throughout substantially the entire outer shell of the firefighter's coat, a first thermal barrier layer within the outer shell, the first thermal barrier layer extending through substantially the entire outer shell of the firefighter's coat, the first thermal barrier layer having given thermal insulation qualities, the improvement comprising a second thermal barrier layer, the second thermal barrier layer being carried by the first thermal barrier layer only in the sleeve portions and in the shoulder portions of the coat, the second thermal barrier layer having thermal insulation qualities different from the thermal insulation qualities of the first thermal barrier layer, whereby the sleeve portions and the shoulder portions of the coat have greater thermal insulation protection than portions of the coat which have only the first thermal barrier layer.

13. A firefighter's garment for complete thermal protection while maintaining minimum weight and maximum flexibility, to create minimum stress within the firefighter who wears the firefighter's garment during firefighting activity, the firefighter's garment having portions which are subjected to high heat loads during firefighting activities, the firefighter's garment being of the type having an outer shell of flame resistant and abrasion resistant material, a moisture barrier layer covered by the outer shell and extending substantially throughout the entire outer shell of the firefighter's garment, a first thermal barrier layer within the outer shell, the first thermal barrier layer extending substantially throughout the entire outer shell of the firefighter's garment, the first thermal barrier layer having given thermal insulation qualities, the improvement comprising a second thermal barrier layer, the second thermal barrier layer being positioned only in portions of the firefighter's garment which are subjected to high heat loads, the second thermal barrier layer having thermal insulation qualities greater than the thermal insulation qualities of the first thermal barrier layer, whereby all portions of the firefighter's garment have thermal insulation protection and the portions of the garment which are subjected to high heat loads have greater thermal insulation protection than portions of the garment which have only a first thermal barrier layer and whereby the firefighter who wears the firefighter's garment is adequately protected by a garment which creates minimum stress in the firefighter.

14. A firefighter's trousers for complete thermal protection while having minimum weight and maximum flexibility, and while creating minimum stress in the firefighter who wears the trousers, the firefighter's trousers having leg portions and a torso portion, the firefighter's trousers being of the type having an outer shell of flame resistant and abrasion resistant material, a moisture barrier layer covered by the outer shell and extending throughout substantially the entire outer shell of the firefighter's trousers, a first thermal barrier layer within the outer shell, the first thermal barrier layer extending through substantially the entire outer shell of the firefighter's trousers, the first thermal barrier layer having given thermal insulation qualities, the improvement comprising a second thermal barrier layer, the second thermal barrier layer being positioned only in the leg portions of the firefighter's trousers and in the torso portion of the firefighter's trousers, the second thermal barrier layer having thermal insulation qualities different from the thermal insulation qualities of the first thermal barrier layer, whereby the said part of the leg portions and the said part of the torso portion of the firefighter's trousers have greater thermal insulation protection than portions of the firefighter's trousers which have only the first thermal barrier layer, whereby the firefighter's trousers have minimum weight and maximum flexibility, thereby creating minimum stress while completely protecting the firefighter.

15. A firefighter's coat for complete thermal protection while having minimum weight and maximum flexibility, to create minimum stress within the firefighter who wears the coat, the firefighter's coat having shoulder portions and arm portions, the firefighter's coat being of the type having an outer shell of flame resistant and abrasion resistant material, a moisture barrier layer covered by the outer shell and substantially coextensive with the outer shell of the firefighter's coat, a first thermal barrier layer within the outer shell and substantially coextensive with the outer shell of the firefighter's coat, the first thermal barrier layer having given thermal insulation qualities, the improvement comprising a second thermal barrier layer, the second thermal barrier layer being positioned only in the shoulder portions of the firefighter's coat and in the arm portions of the firefighter's coat, the second thermal barrier layer having thermal insulation qualities greater than the thermal insulation qualities of the first thermal barrier layer, whereby the said part of the arm portions and the said part of the shoulder portions have greater thermal insulation protection than portions of the firefighter's coat which have only the first thermal barrier layer, the firefighter's coat thus providing complete protection while creating minimum stress upon the firefighter who wears the coat.

16. A method of producing a firefighter's garment which has portions subjected to very high heat loads and which has complete thermal and moisture protection while having minimum weight and maximum flexibility and creating minimum stress within the firefighter who wears the garment, the garment being of the type having an outer shell of abrasion resistant and flame resistant material, a layer of moisture resistant material, the layer of moisture resistant material being covered by the outer shell and being substantially coextensive with the outer shell, and a first layer of thermal insulation material, the first layer of thermal insulation material having given thermal insulation qualities, the first layer of thermal insulation material being substantially coextensive with the outer shell, the method comprising providing a second layer of thermal insulation material in which the second layer of thermal insulation material has thermal insulation qualities different from the thermal insulation qualities of the first layer of thermal insulation material, attaching the second layer of thermal insulation material to the first layer of thermal insulation material only in portions of the firefighter's garment which are subjected to very high heat loads, the firefighter's garment thus providing complete thermal protection and complete moisture protection to the firefighter who wears the firefighter's garment while providing a firefighter's garment having maximum flexibility and minimum weight and thus creating minimum stress within the firefighter.

17. The method of claim 16 in which the second layer of thermal insulation material has thermal insulation qualities greater than the thermal insulation qualities of the first layer of thermal insulation material.

* * * * *